US006263567B1

(12) United States Patent
McGrane

(10) Patent No.: US 6,263,567 B1
(45) Date of Patent: Jul. 24, 2001

(54) METHOD FOR MAKING ELECTRICAL CONNECTOR AND CONNECTOR PRODUCED THEREBY

(75) Inventor: Eugene McGrane, Ormond Beach, FL (US)

(73) Assignee: Homac Manufacturing Company, Ormond Beach, FL (US)

( * ) Notice: Subject to any disclaimer, the term of this patent is extended or adjusted under 35 U.S.C. 154(b) by 0 days.

(21) Appl. No.: 09/477,210

(22) Filed: Jan. 4, 2000

(51) Int. Cl.[7] ..... H01R 43/00
(52) U.S. Cl. ..... 29/884; 29/874; 29/882
(58) Field of Search ..... 29/874, 884, 882

(56) References Cited

U.S. PATENT DOCUMENTS

| | | | |
|---|---|---|---|
| 5,555,620 | 9/1996 | Kies | 29/874 |
| 5,608,965 | 3/1997 | Kies | 29/874 |
| 5,611,142 | 3/1997 | Kies | 29/874 |
| 5,690,516 | 11/1997 | Fillinger | 439/798 |
| 5,766,044 | 6/1998 | Norden | 439/798 |

OTHER PUBLICATIONS

Catalog—"Quality Electrical Connectors and Accessories", The Homac Companies—Industries Division, pp. 30–33.

*Primary Examiner*—Carl J. Arbes

(74) *Attorney, Agent, or Firm*—Allen, Dyer, Doppelt, Milbrath & Gilchrist, P.A.

(57) ABSTRACT

A method for making a connector includes selectively removing material from metal stock to form a monolithic body comprising a bus portion and a plurality of spaced apart stubs extending outwardly therefrom, and engaging a lower open end of each metal post and a respective stub of the monolithic body together. The starting stock need not be the full height of the posts and bus portion. Accordingly, the advantages of using extruded material versus cast material may be obtained without shortcomings in terms of excess material waste and associated expense. Each stub may be frustoconically-shaped with a desired taper angle. In one embodiment, each metal post may have a bore extending therethrough defining the lower open end and also defining an open upper end for receiving at least one electrical conductor. The metal post may also have at least one threaded passageway therein and extending transversely into the bore, such as to receive a fastener for securing the electrical conductor in the bore. In another embodiment, the metal post comprises an uppermost tab with at least one opening therein for receiving a fastener to secure an electrical conductor. An insulating coating may be formed on at least the bus portion and lower portions of the metal posts.

23 Claims, 5 Drawing Sheets

METHOD FOR MAKING ELECTRICAL CONNECTOR AND CONNECTOR PRODUCED THEREBY

FIELD OF THE INVENTION

The present invention relates to the field of electrical connectors, and, more particularly, to an electrical connector and associated manufacturing method.

BACKGROUND OF THE INVENTION

Underground and submersible junction bus connectors are widely used in electrical power distribution systems. One type of such connector is offered under the designation SWEETHEART® by Homac Mfg. Company of Ormond Beach, Florida, the assignee of the present invention. The SWEETHEART® connector is a cast or welded aluminum connector including a bus, or bar, portion and a series of tubular posts extending outwardly from the bus portion. The posts have an open upper end to receive one or more electrical conductors. A threaded bore is provided in the sidewall of the post, and which receives a fastener to secure the electrical conductor within the upper end of the post. An insulating coating is provided on the lower portion of the posts and bus of the connector. In addition, EPDM insulating sleeves may be used to provide waterproof seals for the posts.

Unfortunately, the casting method for making such a connector may result in small trapped bubbles which leave internal voids in the casting. The internal voids may reduce the strength of the connector. The surface texture of the cast parts may be relatively rough, thereby requiring additional grinding or finishing steps. In addition, different molds are typically required for the different connector sizes and configurations. Accordingly, casting may be relatively expensive. In addition, a cast part may have a lower electrical conductivity.

U.S. Pat. Nos. 5,766,044; 5,555,620 and 5,608,965 each discloses an alternate approach to casting of the bus and post connector. A hollow-end milling cutter is used to form the entire extent of the upstanding posts from generally rectangular extruded stock material, and while also leaving the bus or bar portion at the base of the connector. In other words, an integrally formed monolithic connector is produced without casting and starting from extruded aluminum stock.

While the hollow-end milling approach offers a number of potential advantages, there are also shortcomings. In particular, a relatively large amount of the starting aluminum stock material must be removed and is therefore wasted. Also, the cost of the aluminum stock may also be relatively high because the stock must have a height dimension that is at least as great as the bus portion and the full height of the posts.

SUMMARY OF THE INVENTION

In view of the foregoing background, it is therefore an object of the present invention to provide a method for making a bus and post connector without casting, and while reducing the waste and other drawbacks of the hollow-milling cutter based approaches of the prior art.

These and other objects, features and advantages in accordance with the present invention are provided by a method preferably including the steps of: selectively removing material from metal stock to form a monolithic body comprising a bus portion and a plurality of spaced apart stubs extending outwardly therefrom; providing a plurality of metal posts, each metal post having a lower open end; and engaging the lower open end of each metal post and a respective stub of the monolithic body together.

The step of selectively removing material may, for example, comprise using a milling cutter. The metal stock may have a generally rectangular shape, or may have a rectangular base with rectangular fingers extending outwardly from the base. The metal stock may also preferably comprise extruded aluminum and may have a relatively compact height dimension substantially equal to a combined height of the bus portion and stub. The starting stock need not be the full height of the posts and bus portion. Accordingly, the advantages of using extruded material versus casting may be obtained without, for example, the shortcomings in terms of excess material waste and associated expense.

The step of selectively removing material preferably comprises selectively removing material so that each stub is frustoconically-shaped. In addition, the step of providing the metal posts preferably comprises providing each with a correspondingly-shaped lower open end for engaging the respective frustoconically-shaped stub. The frustoconical shape may have a taper angle in a range of about 1–5 degrees, for example. Each stub may also have a generally circular cross-sectional shape.

In one embodiment, each metal post may have a bore extending therethrough defining the lower open end and also defining an open upper end for receiving at least one electrical conductor. In this embodiment, the metal post may also have at least one threaded passageway therein and extending transversely into the bore, such as to receive a fastener for securing the electrical conductor in the bore. Also, the metal post may have an increased thickness wall portion through which the threaded passageway extends.

In another embodiment of the invention, the metal post has a different configuration. More particularly, in this embodiment, the metal post comprises an uppermost tab with at least one opening therein for receiving a fastener to secure an electrical conductor.

The method may also include the step of forming an insulating coating on at least the bus portion and lower portions of the metal posts. The step of selectively removing material may comprise selectively removing material so that all of the stubs have a common height. In addition, the step of providing the metal posts may comprise providing at least some of the metal posts with different shapes, such as to accommodate different sized conductors.

Another aspect of the invention relates to the electrical connector. The connector preferably comprises a monolithic metal body comprising a bus portion and a plurality of spaced apart stubs extending outwardly therefrom, and a plurality of metal posts connected to the stubs. Each metal post preferably has a lower open end engaged on a respective stub and an upper end to be connected to at least one electrical conductor. Each stub may be frustoconically-shaped, and each metal post may have a correspondingly-shaped lower open end for engaging the respective frustoconically-shaped stub.

In one embodiment, each metal post may have a first bore extending therethrough defining the lower open end and also defining an open upper end for receiving at least one electrical conductor therein. In another embodiment, each metal post comprises an uppermost tab with at least one opening therein for receiving a fastener to secure an electrical conductor.

The connector also preferably includes an insulating coating on at least the bus portion and lower portions of the metal posts. In addition, the monolithic metal body and the metal posts may each comprise aluminum, although other metals may be suitable as well. In some configurations, at least one of the metal posts may have a shape different than at least one other metal post, such as to accommodate a different sized electrical conductor.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation is used in alternate embodiments to indicate similar elements.

Referring initially to FIGS. 1–6, an electrical connector 20 and method for making the connector are first described. The electrical connector 20 is of a type that includes a metal bus portion 27 and a plurality of metal towers or posts 30*a*–30*d* extending outwardly therefrom, and wherein each post can receive one or more electrical conductors.

Figure 2:
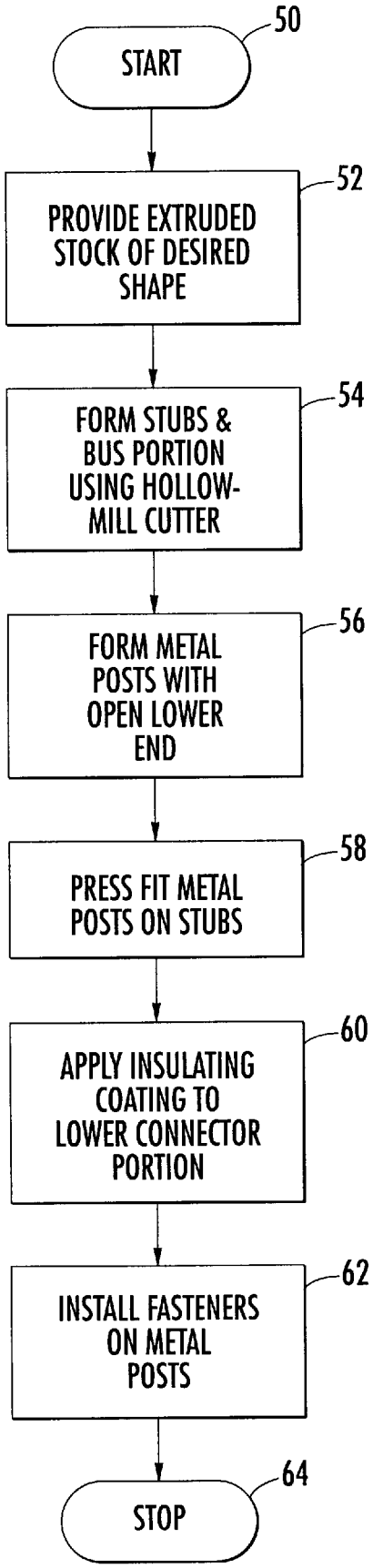
FIG. 2 is a flowchart indicating the steps of making the electrical connector as shown in FIG. 1.

Referring more particularly to the flowchart of FIG. 2, a method aspect of the invention is for making the electrical connector 20. From the start (Block 50) extruded metal stock material of a desired shape is provided. The extruded metal stock may preferably be aluminum as is commonly used in electrical connectors, although other conductive materials may also be used.

Figure 3:
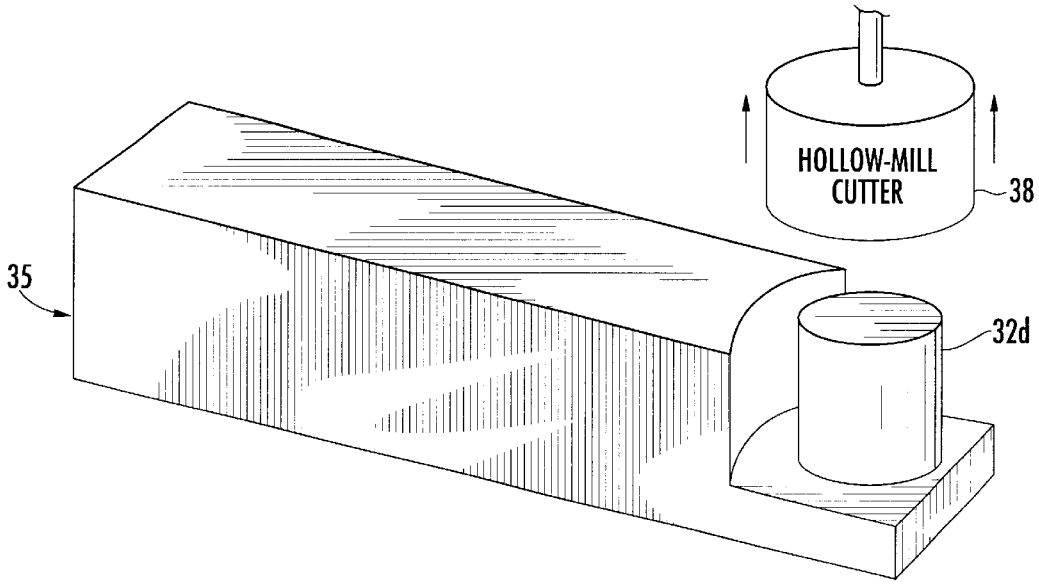
FIG. 3 is a perspective partial schematic view illustrating forming a stub from metal stock in accordance with one embodiment of the present invention.
Figure 4:
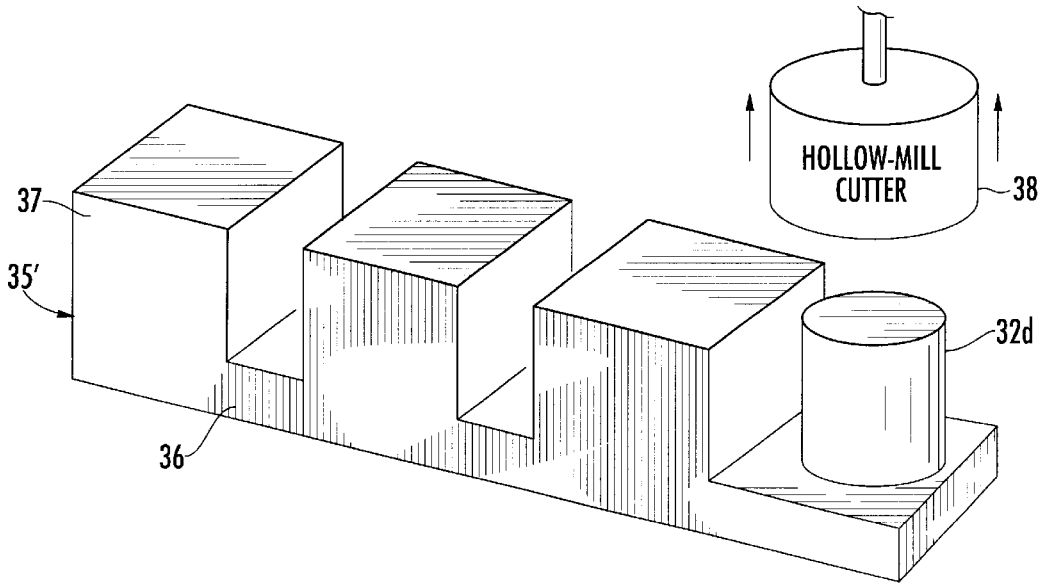
FIG. 4 is a perspective partial schematic view illustrating forming a stub from metal stock in accordance with another embodiment of the present invention.

As shown in FIG. 3, the stock material 35 may have a generally rectangular shape. Alternately, as shown in FIG. 4, the stock material 35' may have a generally rectangular base 36 with rectangular fingers 37 extending outwardly therefrom. This stock material 35' may result in less waste, but does require a more complicated initial extrusion as will be appreciated by those skilled in the art. The stock material 35 (FIG. 3) may be conventionally extruded bar stock, and which is extruded in a longitudinal direction.

In contrast, the stock material 35' (FIG. 4) may be formed from a larger panel, of which only a slice is illustrated. In other words, the extrusion to produce the stock material 35' may be considered to be a lateral extrusion as will be appreciated by those skilled in the art. In other embodiments the metal stock material need not be extruded and can comprise metals other than aluminum.

At Block 54 material is selectively removed from metal stock to form a monolithic body 26 comprising a bus portion 27 and a plurality of spaced apart stubs 32*a*–32*d* extending outwardly therefrom. In accordance with one advantageous feature of the invention, a milling cutter, such as a CNC milling cutter or the illustrated hollow-milling cutter 38 may be used to form the stubs 32*a*–32*d* as will be appreciated by those skilled in the art. As will also be appreciated by those skilled in the art, other conventional machining techniques may be used to form the stubs 32*a*–32*d*.

A significant advantage of the present invention over the prior art described above is that stock material used in accordance with the invention may have a relatively compact height dimension substantially equal to a combined height of the bus portion 27 and stub 30*a*. The starting stock need not be the full height of the posts and bus portion as required in the prior hollow-milling approaches. For example, for a connector 20 wherein the total height of the bus portion 27 and the tallest post 30*d* is about 3.5 inches, a starting stock material 35, 35' having a height of only about 1.25 inches may be used in accordance with the invention. Accordingly, the advantages of using extruded material versus cast material may be obtained in accordance with the invention and without, for example, the shortcomings in terms of excess material waste and associated expense suffered by prior art techniques.

The number, size and spacing of the stubs 32*a*–32*d* is dependent on the particular connector design desired. In the illustrated connector 20 four stubs are illustrated with the rightmost stub 32*d* having a larger diameter to accommodate a larger post 30*d* which, in turn, can accommodate a larger electrical conductor.

The step of selectively removing material may comprise selectively removing material so that all of the stubs 32*a*–32*d* have a common height as shown in the illustrated embodiment. In other embodiments, not all of the stubs need to have the same height. Three to six stubs are used for most commonly desired connector configurations, for example. The stubs 32*a*–32*d* are readily formed to have a generally circular cross-sectional shape using a milling cutter, such as a CNC milling cutter or by using the illustrated hollow-milling cutter 38.

A slight taper angle a (FIG. 5) may be provided to more readily and snugly seat the posts 30*a*–30*d* onto the stubs 32*a*–32*d* as will be readily appreciated by those skilled in the art. For example, the taper angle a may be in a range of about 1–5 degrees, although other angles are also contemplated by the invention. For example, even straight surfaces, that is a taper angle of 0 degrees, may be provided in some embodiments. What is important is that the mating surfaces of the stubs 32*a*–32*d* and posts 30*a*–30*d* match for best mechanical and electric contact as will be appreciated by those skilled in the art. The presence of the taper angle may permit a more accurate description of the shape of the stubs 32*a*–32*d* as "frustoconical" as will be appreciated by those skilled in the art.

At Block 56 the plurality of metal posts 30*a*–30*d* are provided or formed. In other words, the posts may be made up in advance, such as by others, for example, and later assembled to form the connector 20. Alternatively, conventional machining techniques may be used to form the metal posts 30*a*–30*d* as will be readily appreciated by those skilled in the art. For example, for the illustrated posts 30*a*–30*d* wherein a bore 31*a*–31*d* runs completely through the post, a tubular extrusion may be used and cut to the desired lengths for the posts. In this embodiment, each metal post has a lower open end, and also an open upper end to receive one or more electrical connectors therein. In addition, the lower open end may be further machined to have a taper angle corresponding to the taper angle $\alpha$ of the stubs 32*a*–32*d* to provide more secure contact.

Figure 1:
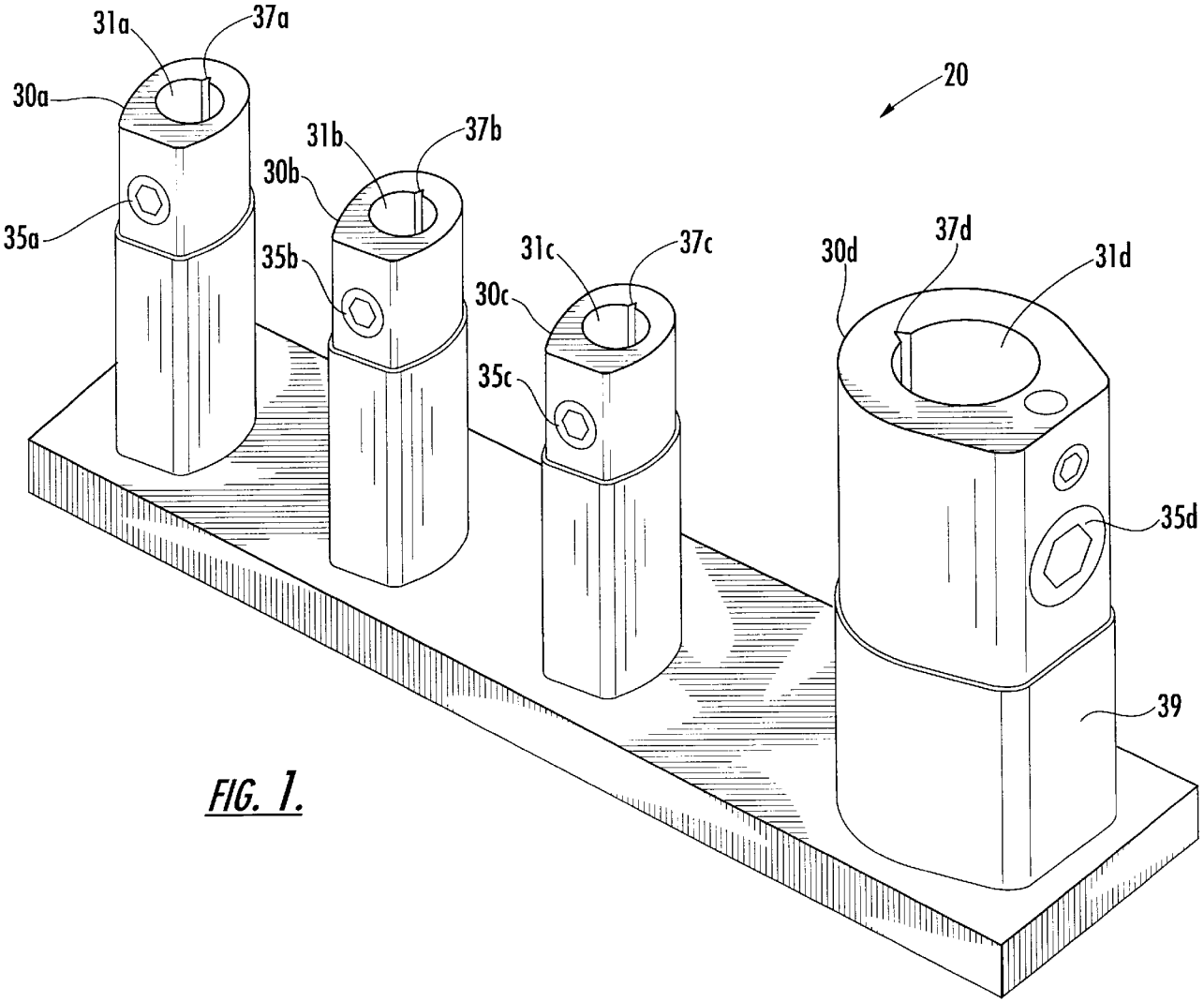
FIG. 1 is a perspective view of the electrical connector in accordance with the present invention.

In this embodiment, each of the metal posts 30*a*–30*d* may also have at least one threaded passageway 34*a*–34*d* (FIG. 5) extending transversely into the bore, such as to receive a fastener for securing the electrical conductor in the bore. For example, the fasteners may be a ball-ended screws 35*a*–35*d*, each having a hexagonal recess therein as illustrated in FIGS. 1 and 6. As also shown in the illustrated embodiment, each metal post 30*a*–30*d* may have an increased thickness wall portion through which the threaded passageway 34*a*–34*d* extends. The increased thickness wall portion permits a more efficient use of material, wherein strength and a larger wall thickness to receive a screw are provided where needed in the illustrated embodiment. Of course, in other embodiments, the wall thickness may be uniform as will be appreciated by those skilled in the art.

The largest metal post 30*d* in the illustrated embodiment also includes a second bore 42, extending in the sidewall parallel to the main bore 31*d*, for receiving a smaller conductor. In addition, a second threaded passageway 41 is provided in communication with the second bore 42 to receive an associated screw or fastener 43 (FIG. 6). Each of the metal posts 30*a*–30*d* also includes a vertical groove or recess 37*a*–37*d* (FIGS. 1 and 6) which permits receiving a smaller gauge wire or conductor also in the main bore as will be appreciated by those skilled in the art. The illustrated metal posts 30*a*–30*d* include three identical posts 30*a*–30*c* and one larger post 30*d*. In other embodiments, all of the posts may be identical, for example, as will also be appreciated by those skilled in the art.

Figure 7:
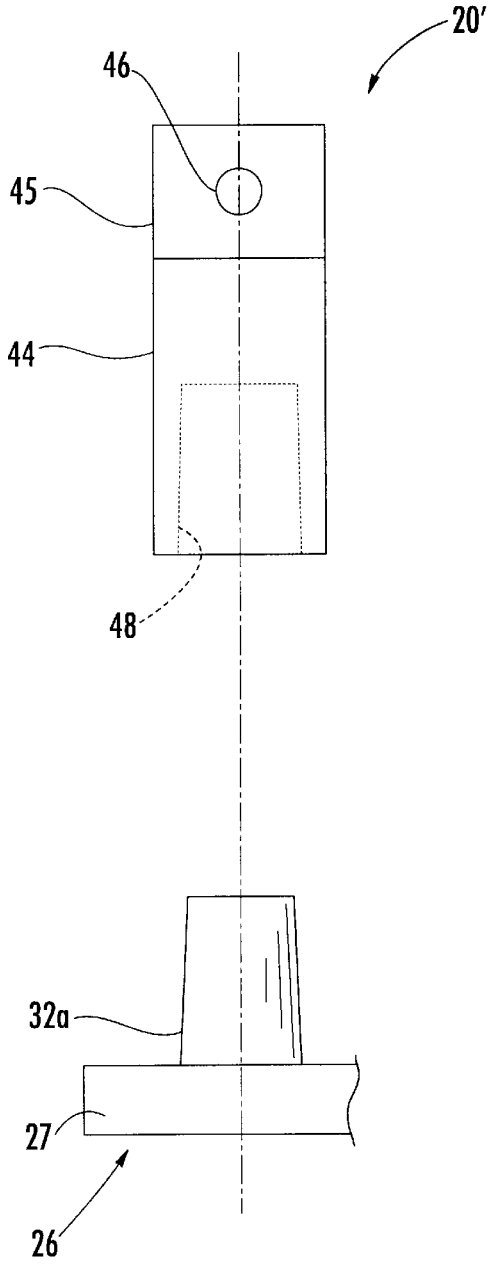
FIG. 7 is a side exploded view of a portion of an alternate embodiment of an electrical connector in accordance with the invention.
Figure 8:
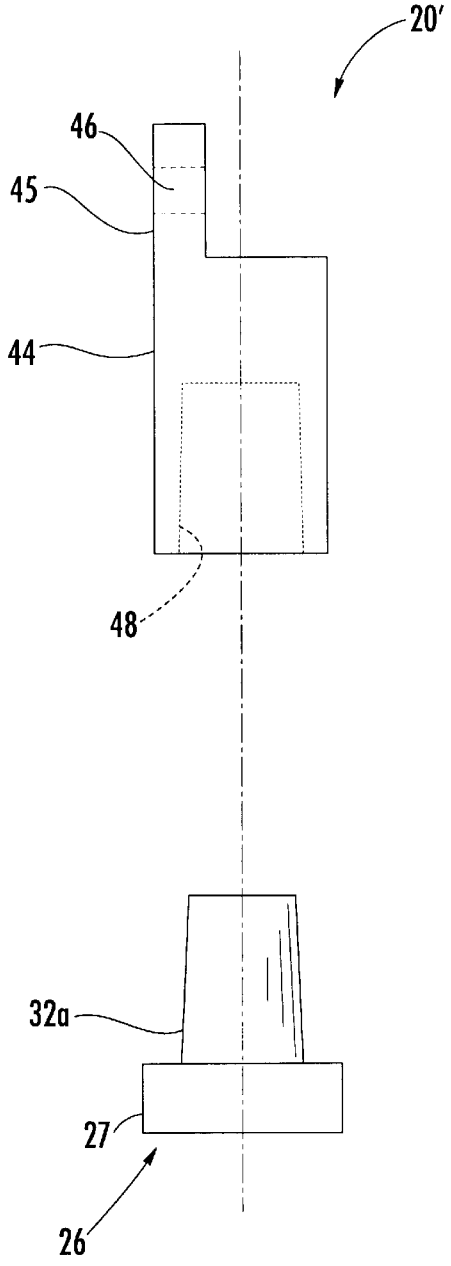
FIG. 8 is an end exploded view of the portion of the alternate embodiment of the electrical connector as shown in FIG. 7.

Referring now briefly to FIGS. 7 and 8, in another embodiment of the invention, a metal post 44 has a different configuration for the connector 20'. In this embodiment, the metal post 44 comprises an uppermost tab 45 with at least one opening 46 therein for receiving a fastener, not shown, to secure an electrical conductor thereto. The lower end of the post 44 includes an opening or bore 48 therein to be seated onto the stub 32*a*. Of course, this type of post 44 can be used exclusively or mixed and matched with the posts 30*a*–30*d* described above.

At Block 58 the posts 30*a*–30*d* are assembled onto the stubs 32*a*–32*d* of the monolithic body 26. More particularly, the lower open ends of the metal posts 30*a*–30*d* are press fit onto the stubs 32*a*–32*d*. A mechanically strong and electrically good connection is established between the stubs 32*a*–32*d* and the metal posts 30*a*–30*d*. Typically, the mechanical press fit engagement is all that is required to connect the stubs and posts. The contact surface between each stub and respective metal post can be altered by varying the size and/or shape of the stub to thereby provide a desired degree of mechanical strength and electrical conductivity as will be appreciated by those skilled in the art.

At Block 60 an insulative coating 39, such as plastic or rubber, may optionally be applied to the lower portion of the connector 20 as shown in FIG. 1. At Block 62 any screws or other fasteners can be installed, before stopping (Block 64).

Summarizing the description of the connector 20 in accordance with the invention, the connector comprises a monolithic metal body 26 including a bus portion 27 and a plurality of spaced apart stubs 32*a*–32*d* extending outwardly therefrom, and a plurality of metal posts 30*a*–30*d* connected to the stubs. Each metal post 30*a*–30*d* preferably has a lower open end engaged on a respective stub 30*a*–30*d* and an upper end to be connected to at least one electrical conductor. Each stub 30*a*–30*d* may be frustoconically-shaped, and each metal post 32*a*–32*d* may have a correspondingly shaped lower open end for engaging the respective frustoconically-shaped stub.

Figure 5:
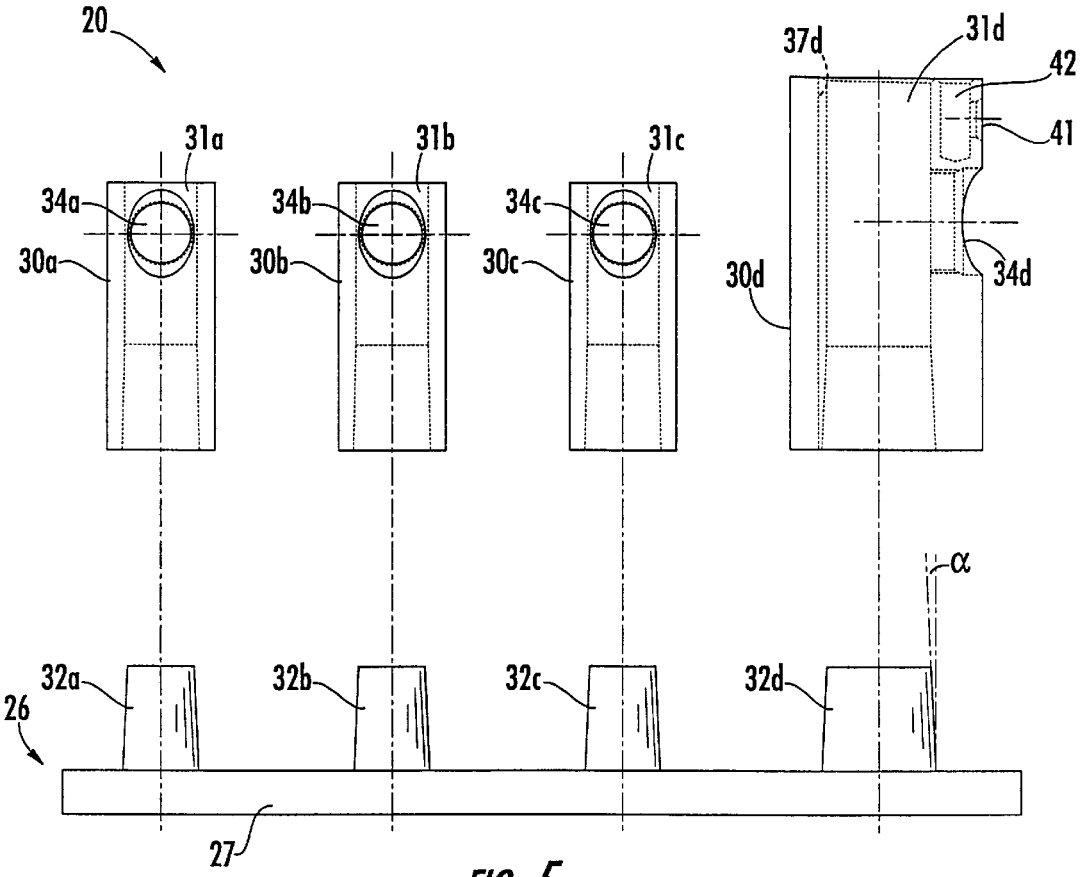
FIG. 5 is a side exploded view of the electrical connector as shown in FIG. 1.
Figure 6:
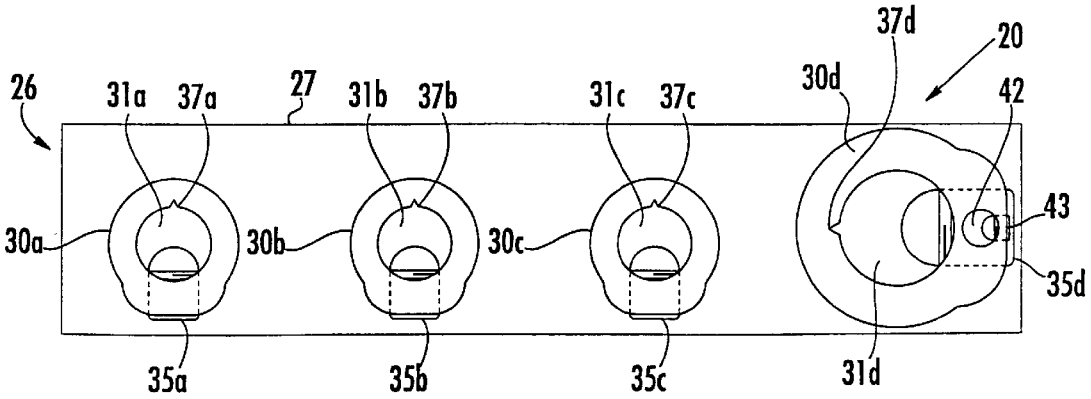
FIG. 6 is a top plan view of the electrical conductor as shown in FIG. 1.

In one embodiment as shown in FIGS. 1, 5 and 6, each metal post 30*a*–30*d* may have a first bore 31*a*–31*d* extending therethrough defining the lower open end and also defining an open upper end for receiving at least one electrical conductor therein. In another connector 20' embodiment as shown in FIGS. 7 and 8, each metal post 44 comprises an uppermost tab 45 with at least one opening 46 therein for receiving a fastener to secure an electrical conductor thereto. The connector 20 also preferably includes an insulating coating 39 on at least the bus portion and lower portions of the metal posts as shown in FIG. 1.

Many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that the modifications and embodiments are intended to be included within the spirit and scope of the appended claims.

That which is claimed is:

1. A method for making an electrical connector comprising a bus portion and a plurality of posts extending outwardly therefrom, the method comprising the steps of:

providing metal stock having a predetermined shape;

selectively removing material from the metal stock to form a monolithic body comprising a bus portion and a plurality of spaced apart stubs extending outwardly therefrom;

providing a plurality of metal posts, each metal post having a lower open end; and engaging the lower open end of each metal post and a respective stub of the monolithic body together.

2. A method according to claim 1 wherein the step of selectively removing material comprises using a milling cutter.

3. A method according to claim 1 wherein the predetermined shape of the metal stock is generally rectangular.

4. A method according to claim 1 wherein the predetermined shape of the metal stock is defined by a generally rectangular base with generally rectangular fingers extending outwardly therefrom.

5. A method according to claim 1 wherein the step of selectively removing material comprises selectively removing material so that each stub is frustoconically-shaped; and wherein the step of providing the metal posts comprises providing each metal post with a correspondingly-shaped lower open end for engaging the respective frustoconically-shaped stub.

6. A method according to claim 5 wherein the frustoconical shape has a taper angle in a range of about 1–5 degrees.

7. A method according to claim 1 wherein the step of selectively removing material comprises selectively removing material so that each stub has a generally circular cross-sectional shape.

8. A method according to claim 1 wherein the metal stock comprises extruded aluminum.

9. A method according to claim 1 wherein the step of providing the metal posts comprises providing each metal post having a bore extending therethrough defining the lower open end and an open upper end for receiving at least one electrical conductor therein.

10. A method according to claim 9 wherein the step of providing the metal posts comprises providing each metal post to have at least one threaded passageway therein and extending transversely into the bore.

11. A method according to claim 10 wherein the step of providing the metal posts comprises providing each metal post having an increased thickness wall portion through which the at least one threaded passageway extends.

12. A method according to claim 1 wherein the step of providing the metal posts comprises providing each metal post to comprise an uppermost tab with at least one opening therein for receiving a fastener to secure an electrical conductor thereto.

13. A method according to claim 1 further comprising the step of forming an insulating coating on at least the bus portion and lower portions of the metal posts.

14. A method according to claim 1 wherein each metal post comprises aluminum.

15. A method according to claim 1 wherein the step of selectively removing material comprises selectively removing material so that all of the stubs have a common height.

16. A method according to claim 1 wherein the step of providing the metal posts comprises providing at least some of the metal posts with different shapes.

17. A method for making an electrical connector comprising a bus portion and a plurality of posts extending outwardly therefrom, the method comprising the steps of:

selectively removing material from metal stock using a milling cutter to form a monolithic body comprising a bus portion and a plurality of spaced apart stubs extending outwardly therefrom;

forming a plurality of metal posts, each metal post having a lower open end; and engaging the lower open end of each metal post and a respective stub of the monolithic body together.

18. A method according to claim 17 wherein the metal stock has a height dimension substantially equal to a combined height of the bus portion and stub.

19. A method according to claim 17 wherein the step of selectively removing material comprises selectively removing material so that each stub is frustoconically-shaped; and wherein the step of providing the metal posts comprises providing each metal post with a correspondingly-shaped lower open end for engaging the respective frustoconically-shaped stub.

20. A method according to claim 17 wherein the step of selectively removing material comprises selectively removing material so that each stub has a generally circular cross-sectional shape.

21. A method according to claim 17 wherein the step of forming the metal posts comprises forming each metal post having a bore extending therethrough defining the lower open end and an open upper end for receiving at least one electrical conductor therein.

22. A method according to claim 17 wherein the step of forming the metal posts comprises forming each metal post to comprise an uppermost tab with at least one opening therein for receiving a fastener to secure an electrical conductor thereto.

23. A method according to claim 17 further comprising the step of forming an insulating coating on at least the bus portion and lower portions of the metal posts.

* * * * *